US010370824B2

(12) United States Patent
Hiraku et al.

(10) Patent No.: US 10,370,824 B2
(45) Date of Patent: Aug. 6, 2019

(54) WORK MACHINE

(71) Applicant: Hitachi Construction Machinery Co., Ltd., Taito-ku, Tokyo (JP)

(72) Inventors: Kenji Hiraku, Ibaraki (JP); Hiromasa Takahashi, Chiba (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 379 days.

(21) Appl. No.: 15/122,540

(22) PCT Filed: Mar. 13, 2015

(86) PCT No.: PCT/JP2015/057511

§ 371 (c)(1),
(2) Date: Aug. 30, 2016

(87) PCT Pub. No.: WO2015/182216

PCT Pub. Date: Dec. 3, 2015

(65) Prior Publication Data

US 2017/0073931 A1 Mar. 16, 2017

(30) Foreign Application Priority Data

May 30, 2014 (JP) ..... 2014-112719

(51) Int. Cl.
*F15B 11/17* (2006.01)
*E02F 9/22* (2006.01)
(Continued)

(52) U.S. Cl.
CPC ..... *E02F 9/22* (2013.01); *E02F 9/2228* (2013.01); *E02F 9/2264* (2013.01);
(Continued)

(58) Field of Classification Search
CPC ... E02F 3/32; E02F 9/22; E02F 9/2228; E02F 9/2264; E02F 9/2289; E02F 9/2292;
(Continued)

(56) References Cited

U.S. PATENT DOCUMENTS 3,146,593 A * 9/1964 Stacey ..... E02F 3/32 60/421
9,810,246 B2 * 11/2017 Akiyama ..... E02F 9/2235
(Continued)

FOREIGN PATENT DOCUMENTS

JP 2007-315506 A 12/2007
JP 2009-511831 A 3/2009
(Continued)

OTHER PUBLICATIONS

"Centrifugal Pump System Tutorial", Mar. 15, 2012, www.pumpfundamentals.com/tutorial2.htm.*
(Continued)

*Primary Examiner* — Thomas E Lazo
(74) *Attorney, Agent, or Firm* — Crowell & Moring LLP

(57) ABSTRACT

To provide a work machine which, in a configuration provided with a closed-circuit pump and an open-circuit pump, is capable of stabilizing respective pump operations of the closed-circuit pump and the open-circuit pump and of improving the mountability of the closed-circuit pump and the open-circuit pump. The present invention is provided with a closed circuit in which a closed-circuit pump and a boom cylinder are connected annularly, and an open circuit which has an open-circuit pump for making hydraulic fluid flow in from a reservoir and flow out and a connection passage capable of introducing hydraulic fluid into the closed circuit, wherein the closed-circuit pump is installed above the open-circuit pump.

3 Claims, 7 Drawing Sheets

(51) Int. Cl.

| | |
|---|---|
| *E02F 3/32* | (2006.01) |
| *F15B 7/00* | (2006.01) |
| *F15B 21/14* | (2006.01) |

(52) U.S. Cl.

CPC ..... *E02F 9/2289* (2013.01); *E02F 9/2292* (2013.01); *E02F 9/2296* (2013.01); *E02F 3/32* (2013.01); *F15B 7/006* (2013.01); *F15B 11/17* (2013.01); *F15B 21/14* (2013.01); *F15B 2211/20546* (2013.01); *F15B 2211/20569* (2013.01); *F15B 2211/20576* (2013.01); *F15B 2211/27* (2013.01); *F15B 2211/30595* (2013.01); *F15B 2211/613* (2013.01); *F15B 2211/7135* (2013.01); *F15B 2211/7142* (2013.01); *F15B 2211/785* (2013.01)

(58) Field of Classification Search

CPC ..... E02F 9/2296; F15B 7/006; F15B 11/17; F15B 21/14; F15B 2211/20546; F15B 2211/20569; F15B 2211/20576; F15B 2211/27; F15B 2211/30595; F15B 2211/613; F15B 2211/7135; F15B 2211/7142; F15B 2211/785

See application file for complete search history.

(56) References Cited

U.S. PATENT DOCUMENTS

| | | | |
|---|---|---|---|
| 2007/0079609 | A1 | 4/2007 | Brinkman et al. |
| 2012/0065149 | A1 | 3/2012 | Vonderwell |

FOREIGN PATENT DOCUMENTS

| | | | | |
|---|---|---|---|---|
| JP | 2014-84558 | A | | 5/2014 |
| RO | 126318 | | * | 5/2011 |
| WO | WO 2005/024246 | A1 | | 3/2005 |

OTHER PUBLICATIONS

International Search Report (PCT/ISA/210) issued in PCT Application No. PCT/JP2015/057511 dated Jun. 9, 2015 with English translation (four pages).

Japanese-language Written Opinion (PCT/ISA/237) issued in PCT Application No. PCT/JP2015/057511 dated Jun. 9, 2015 (three pages).

* cited by examiner

WORK MACHINE

TECHNICAL FIELD

The present invention relates to a work machine such as, for example, a hydraulic excavator and particularly, to a work machine having a closed-circuit hydraulic pump annularly connected to a single-rod cylinder and an open-circuit hydraulic pump that makes hydraulic fluid flow out from a reservoir.

BACKGROUND ART

In recent years, in work machines such as hydraulic excavators and wheel loaders, energy saving has become a major development item in terms of so-called energy problems. Work machines of this kind use a hydraulic drive system for hydraulically driving a working section such as a front working device, and thus, the energy saving of the hydraulic drive system itself is important. As the hydraulic drive system, there has been known a hydraulic circuit referred to as a so-called closed circuit, wherein connection is made annularly (in a closed-circuit fashion) so that hydraulic fluid from a hydraulic pump being a pressure generation source is fed directly to a single-rod cylinder being a hydraulic actuator and that hydraulic fluid after used in performing a desired work by driving the single-rod cylinder is returned directly to the single-rod cylinder.

On the other hand, in contrast with the closed circuit, there has also been known a hydraulic circuit referred to as a so-called open circuit, in which hydraulic fluid is fed from a hydraulic pump to a single-rod cylinder through a restrictor configured by a control valve and in which the hydraulic fluid (return hydraulic fluid) that flows out from the single-rod cylinder is drained into a reservoir. Compared with the hydraulic circuit in the open-circuit fashion, the hydraulic circuit in the closed-circuit fashion is advantageous in fuel consumption performance because a pressure loss caused by a restrictor is little and because regeneration by the hydraulic pump is possible with the energy that the return hydraulic fluid from the single-rod cylinder possesses.

Further, Patent Literature 1 discloses prior art in which closed circuits of this kind are combined. In Patent Literature 1, there is installed a first closed circuit in which a hydraulic pump is connected to a boom cylinder being a single-rod cylinder in a closed circuit fashion, and there is also installed a second closed circuit in which a hydraulic pump is connected to an arm cylinder in a closed circuit fashion. Furthermore, an open circuit is installed in which a hydraulic pump is connected to a bucket cylinder through a control valve, and a distribution circuit that distributes the hydraulic fluid discharged from the hydraulic pump of the open circuit to the boom cylinder and the arm cylinder is provided to branch from a side closer to the hydraulic pump than the control valve in the open circuit.

Further, generally, a work machine such as a hydraulic excavator mounts a plurality of hydraulic pumps. Particularly, because in the case of a large-size hydraulic excavator, a working section itself to be driven becomes large in dimension, hydraulic fluid at a large flow rate becomes necessary for driving a hydraulic actuator that drives the working section. Then, Patent Literature 2 discloses prior art with a plurality of hydraulic pumps mounted thereon. In Patent Literature 2, the driving power of an engine is divided by a pump transmission for driving a plurality of hydraulic pumps.

CITATION LIST

Patent Literature

Patent Literature 1: WO 2005/024246
Patent Literature 2: JP-A No. 2007-315506

SUMMARY OF THE INVENTION

Technical Problem

In the prior art disclosed in Patent Literature 1 as aforementioned, the hydraulic pumps in the closed circuits and the hydraulic pump in the open circuit are combined to greatly reduce the restrictor loss caused by the customary control valve and to be capable of recovering brake power when the boom cylinder or the like is operated by a load. Generally, a hydraulic pump in an open circuit draws hydraulic fluid from a reservoir to supply the hydraulic fluid, and thus, where the installation position of the hydraulic pump in the open circuit is higher than the installation position of the reservoir, a larger quantity of energy is required to draw the hydraulic fluid from the reservoir, so that the pump operation of the hydraulic pump in the open circuit is hard to be stabilized. On the contrary, a hydraulic pump in a closed circuit circulates the hydraulic fluid in the closed circuit to supply the hydraulic fluid, and thus, the pump operation of the hydraulic pump in the closed circuit is hard to be influenced by the installation position. Furthermore, although these hydraulic pumps are preferred to be installed in three dimensions from the standpoint of improving mountability, the installation positions should be determined taking the characteristics or the like of these hydraulic pumps into consideration.

The present invention has been made taking the aforementioned circumstances in the prior art into consideration, and an object thereof is to provide a work machine which, in a configuration provided with a closed-circuit hydraulic pump and an open-circuit hydraulic pump, is capable of stabilizing respective pump operations of these closed-circuit hydraulic pump and open-circuit hydraulic pump and of improving the mountability of these closed-circuit hydraulic pump and open-circuit hydraulic pump.

Solution to Problem

In order to achieve this object, the present invention resides in a work machine including: a closed circuit provided with at least one closed-circuit hydraulic pump having two outlet/inlet ports each enabling the outlet and inlet of hydraulic fluid in both directions and a single-rod cylinder having a piston, a cap-end chamber into which the hydraulic fluid is introduced when the piston extends, and a rod-end chamber into which the hydraulic fluid is introduced when the piston retracts, the two outlet/inlet ports of the closed-circuit hydraulic pump being annularly connected with the cap-end chamber and the rod-end chamber; and an open circuit provided with an open-circuit hydraulic pump having an inlet port into which hydraulic fluid flows from a reservoir, and an outlet port from which hydraulic fluid flows out, and a connection circuit which introduces the hydraulic fluid flowing out from the open-circuit hydraulic pump into the closed circuit; wherein the closed-circuit hydraulic pump is installed above the open-circuit hydraulic pump.

In the present invention configured like this, the closed circuit has the cap-end chamber and the rod-end chamber of the single-rod cylinder annularly connected to the two outlet/inlet ports of the closed-circuit hydraulic pump and thus, extends and retracts the single-rod cylinder by circulating the hydraulic fluid in the closed circuit. On the other hand, the cap-end chamber and the bottom chamber of the single-rod cylinder differ in pressurized area, and thus, where the single-rod cylinder is to extend, hydraulic fluid of the quantity equivalent to the difference in the pressurized area is supplied, in addition to the supply of hydraulic fluid from the closed-circuit hydraulic pump, from the reservoir to the bottom chamber through the open-circuit hydraulic pump.

This open-circuit hydraulic pump draws the hydraulic fluid in the reservoir and discharges the oil to the bottom chamber of the single-rod cylinder. On the other hand, the closed-circuit hydraulic pump drives the single-rod cylinder by circulating the hydraulic fluid in the closed circuit and hence, is not required to draw hydraulic fluid from the reservoir as the open-circuit hydraulic pump does. Generally, the open-circuit hydraulic pump draws hydraulic fluid from the reservoir through a suction pipe interconnected with the reservoir and the open-circuit hydraulic pump, and the suction performance is influenced by a pressure loss of the suction pipe in addition to the self-priming efficiency possessed by the open-circuit hydraulic pump. From the standpoint of the self-priming efficiency, consideration is taken into suction capacity of the open-circuit hydraulic pump, and usually, the suction pipe is connected with a bottom face of the reservoir and then, after passing through the lower side of the bottom face, is connected with a bottom face of the hydraulic pump located above the bottom face of the reservoir. Further, the pressure loss of the suction pipe depends on the section area and length of the pipe. Accordingly, in order to improve the suction capability, it is necessary that the suction pipe is connected as described above and is limited to a required minimum length.

In the present invention, the closed-circuit hydraulic pump is placed above the open-circuit hydraulic pump, with which configuration the suction pipe can be made as short as possible and can be restrained in pressure loss.

Advantageous Effect of Invention

According to the present invention, the installation of the closed-circuit hydraulic pump above the open-circuit hydraulic pump can make the suction pipe for the open-circuit hydraulic pump as short as possible, can restrain the pressure loss of the suction pipe and can improve the suction capability of the open-circuit hydraulic pump even in a pump mounting structure wherein the closed-circuit hydraulic pump and the open-circuit hydraulic pump coexist. Further, because the suction pipe can be made as short as possible, the mounting becomes easy, and a cost reduction can be realized. Further, other objects, configurations and advantageous effects than those as mentioned above will be further clarified by the description of the following embodiments.

BRIEF DESCRIPTION OF DRAWINGS

FIG. is a schematic view showing a hydraulic excavator being one example of a work machine according to a first embodiment of the present invention.

DESCRIPTION OF EMBODIMENTS

Hereinafter, embodiments of the present invention will be described with reference to the drawings.

First Embodiment

Figure 1:
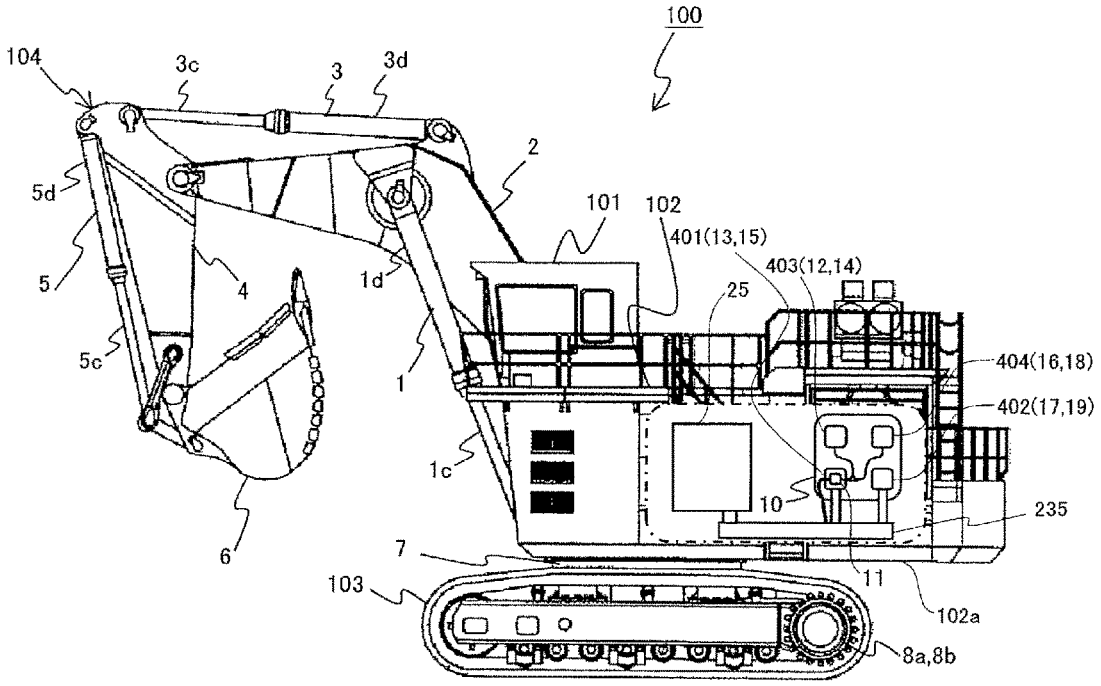
Figure 2:
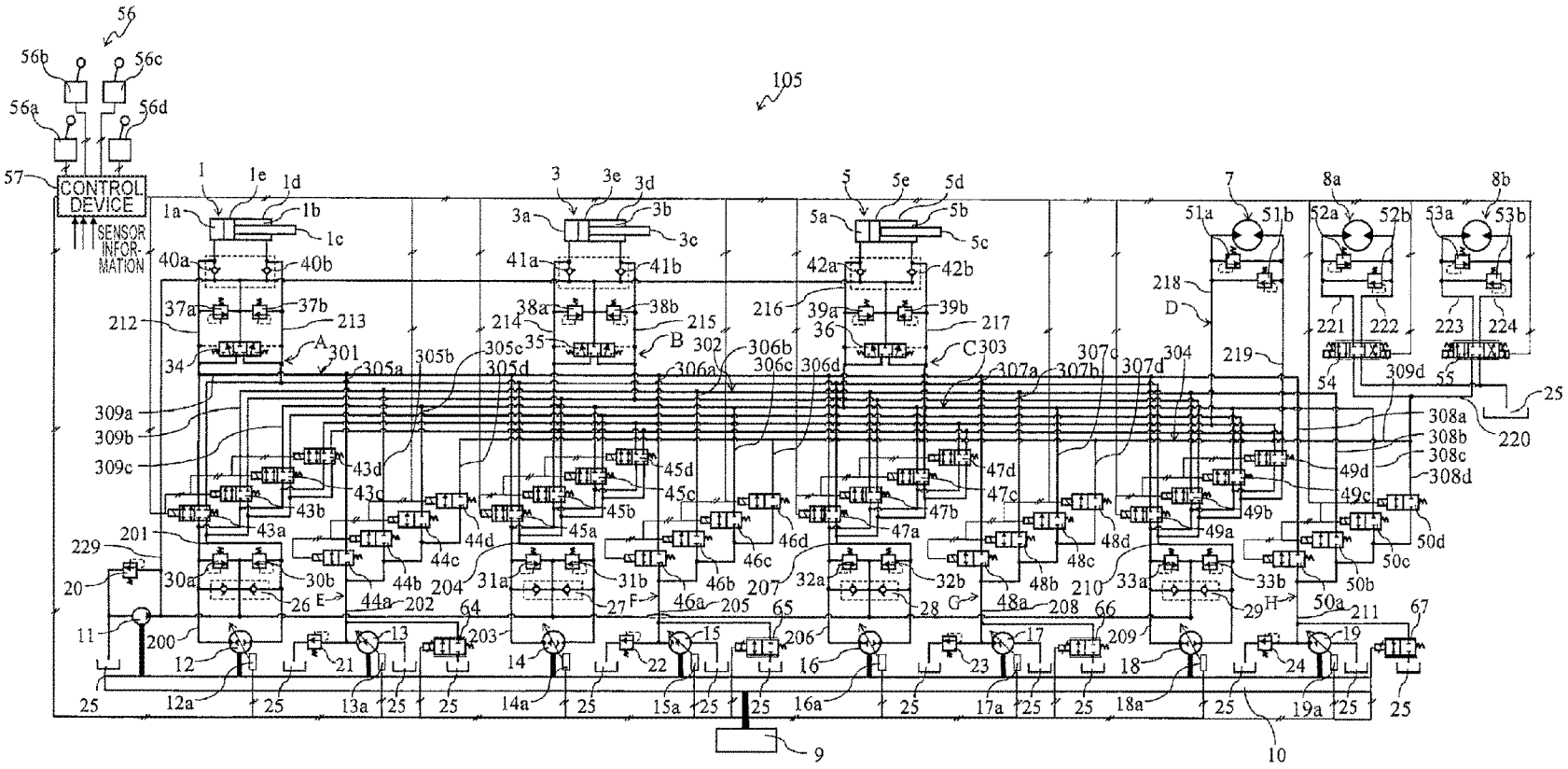
FIG. 2 is a hydraulic circuit diagram showing the system configuration of a hydraulic drive system mounted on the hydraulic excavator.

FIG. 1 is a schematic view showing a hydraulic excavator being one example of a work machine according to a first embodiment of the present invention. FIG. 2 is a hydraulic circuit diagram showing the system configuration of a hydraulic drive system mounted on the hydraulic excavator. The present first embodiment is designed so that in a so-called open-circuit assist configuration wherein a closed circuit having a closed-circuit pump for effecting a retraction operation of a single-rod cylinder is combined with an open circuit having an open-circuit pump for offsetting the pressurized area difference that occurs when the single-rod cylinder extends, the closed-circuit pump is installed above the open-circuit pump to realize the stabilization in respective pump operations of these closed-circuit pump and open-circuit pump and an improvement in layout capability.

<Entire Construction>

A hydraulic excavator 100 will be described as an example of a work machine which mounts a hydraulic drive system 105 shown in FIG. 2 thereon according to the first embodiment of the present invention. As shown in FIG. 1, the hydraulic excavator 100 is provided with an undercarriage 103 that is equipped with travel devices 8*a*, 8*b* of the crawler type on both sides in a right-left direction, and a upperstructure 102 mounted swingably on the undercarriage 103. A cab 101 into which an operator gets is provided on the upperstructure 102. The undercarriage 103 and the upperstructure 102 are swingable through a swing device 7.

On its front side, the upperstructure 102 pivotably attaches a base end portion of a front working device 104 being an actuator for performing excavation works, for example. Here, the front side means a front direction of the cab 101 (the leftward direction in FIG. 1). The front working device 104 is provided with a boom 2 whose base end portion is coupled to the front side of the upperstructure 102 to be pivotable in an upward-downward direction. The boom 2 is operated by the agency of a boom cylinder 1 being a single-rod cylinder that is telescopically operated by being supplied with hydraulic fluid (pressurized oil). The boom cylinder 1 is coupled to the upperstructure 102 at an extreme end of a rod 1*c* and is coupled to the boom 2 at a base end portion of a cylinder tube 1*d*.

As shown in FIG. 2, the boom cylinder 1 is provided with a cap-end chamber 1*a* that is located on on a base end side of the cylinder tube 1*d* and that when supplied with hydraulic fluid, presses a piston 1*e* attached to a base end portion of the rod 1*c* to move the rod 1*c* for extension.

Further, the boom cylinder 1 is provided with a rod-end chamber 1*b* that is located on a distal end side of the cylinder tube 1*d* and that when supplied with hydraulic fluid, presses the piston 1*e* to move the rod 1*c* for retraction.

A base end portion of an arm 4 is coupled with a distal end portion of the boom 2 pivotably in an upward-downward direction. The arm 4 is operated by the agency of an arm cylinder 3 being a single-rod cylinder. The arm cylinder 3 is coupled to the arm 4 at a distal end of a rod 3*c*, and a cylinder tube 3*d* of the arm cylinder 3 is coupled to the boom 2. As shown in FIG. 2, the arm cylinder 3 is provided with a cap-end chamber 3*a* that is located on a base end side of the cylinder tube 3*d* and that when supplied with hydraulic fluid, presses a piston 3*e* attached to a base end portion of the rod 3*c* to move the rod 3*c* for extension. Further, the arm cylinder 3 is provided with a rod-end chamber 3*b* that is located on a distal end side of the cylinder tube 3*d* and that when supplied with hydraulic fluid, presses the piston 3*e* to move the rod 3*c* for retraction.

A base end portion of a bucket 6 is coupled with a distal end portion of the arm 4 pivotably in an upward-downward direction. The bucket 6 is operated by the agency of a bucket cylinder 5 being a single-rod cylinder. The bucket cylinder 5 is coupled with the bucket 6 at a distal end of a rod 5*c*, and a cylinder tube 5*d* of the bucket cylinder 5 is coupled to the arm 4 at a base end thereof. The bucket cylinder 5 is provided with a cap-end chamber 5*a* that is located on the base end side of the cylinder tube 5*d* and that when supplied with hydraulic fluid, presses a piston 5*e* attached to a base end portion of the rod 5*c* to move the rod 5*c* for extension. Further, the bucket cylinder 5 is provided with a rod-end chamber 5*b* that is located on a distal end side of the cylinder tube 5*d* and that when supplied with hydraulic fluid, presses the piston 5*e* to move the rod 5*c* for retraction.

Each of the boom cylinder 1, the arm cylinder 3 and the bucket cylinder 5 is telescopically operated by hydraulic fluid supplied thereto and is driven to be extended or retracted in dependence on the supply direction of the hydraulic fluid supplied. The hydraulic drive system 105 drives the swing device 7 and the travel devices 8*a*, 8*b* in addition to the boom cylinder 1, the arm cylinder 3 and the bucket cylinder 5 that constitute the front working device 104. These swing device 7 and the travel devices 8*a*, 8*b* are hydraulic motors that are rotationally driven by being supplied with hydraulic fluid.

As shown in FIG. 2, the hydraulic drive system 105 drives the boom cylinder 1, the arm cylinder 3, the bucket cylinder 5, the swing device 7 and the travel devices 8*a*, 8*b* that are hydraulic actuators, in accordance with the manipulation of a control lever device 56 as a control section installed in the cab 101. The extension and retraction movements of the boom cylinder 1, the arm cylinder 3 and the bucket cylinder 5, that is, the moving directions and moving speeds thereof are instructed by the operation directions and manipulated variables of respective control levers 56*a* to 56*d* of the control lever device 56.

The hydraulic drive system 105 uses an engine 9 as a power source. The engine 9 is connected to a power transmission device 10 that is composed of, for example, predetermined gears and the like for distributing powers. The power transmission device 10 has connected thereto variable-displacement closed-circuit pumps 12, 14, 16, 18, variable-displacement open-circuit pumps 13, 15, 17, 19, and a charge pump 11 that when hydraulic pressures in the respective closed circuits A to D go down, replenishes hydraulic fluid to secure the hydraulic pressure in these closed circuits A to D. Details in layout configuration of the engine 9, the power transmission device 10, the closed-circuit pumps 12, 14, 16, 18, the open-circuit pumps 13, 15, 17, 19 and the charge pump 11 will be described later.

The closed-circuit pumps 12, 14, 16, 18 are used in the closed circuits A to D referred to later and are each provided with a double-tilting swash plate mechanism (not shown) capable of discharging hydraulic fluid in both directions in order to control the driving of a corresponding hydraulic actuator by changing the discharge direction of the hydraulic fluid. Further, each of the closed-circuit pumps 12, 14, 16, 18 has a pair of outlet/inlet ports each enabling hydraulic fluid to flow in and out in both directions. Furthermore, each of the closed-circuit pumps 12, 14, 16, 18 is provided with a regulator 12*a*, 14*a*, 16*a*, 18*a* as a flow rate adjusting section that adjusts the tilt angle (inclination angle) of a swash plate of the double-tilting type constituting the double-tilting swash plate mechanism. On the other hand, the open-circuit pumps 13, 15, 17, 19 are used in open circuits E to H which discharge hydraulic fluid drawn from a reservoir 25 and in which changeover valves 44*a* to 44*d*, 46*a* to 46*d*, 48*a* to 48*d*, 50*a* to 50*d* control the supply direction of hydraulic fluid. These open-circuit pumps 13, 15, 17, 19 are each provided with a single-tilting swash plate mechanism capable of discharging hydraulic fluid in one direction only. Then, these open-circuit pumps 13, 15, 17, 19 are each provided with an output port being the outlet side of hydraulic fluid and an input port being the inlet side of hydraulic fluid. Further, the open-circuit pumps 13, 15, 17, 19 are each provided with a regulator 13*a*, 15*a*, 17*a*, 19*a* as a flow rate adjusting section that adjusts the tilt angle (inclination angle) of a swash plate of a single-tilting type constituting a single-tilting swash plate mechanism. The open-circuit pumps 13, 15, 17, 19 each discharge hydraulic fluid at a flow rate being equal to and higher than a predetermined rate (minimum discharge flow rate). Each regulator 12*a* to 19*a* is a flow rate control section that adjusts the tilt angle of the swash plate of a corresponding one of the closed-circuit pumps and the open-circuit pumps 12 to 19 in response to a control signal outputted from a control device 57 being a controller to control the flow rate of the hydraulic fluid discharged from these closed-circuit pumps and open-circuit pumps 12 to 19. Incidentally, the closed-circuit pumps and the open-circuit pumps 12 to 19 may each suffice to be of the variable tilting mechanism type such as an inclined shaft mechanism, but is not limited to that of the swash plate mechanism type.

As mentioned earlier, the closed-circuit pumps 12, 14, 16, 18 are hydraulic pumps for use in closed circuits as closed-circuit hydraulic pumps connected to the closed circuits A to D. The open-circuit pumps 13, 15, 17, 19 are hydraulic pumps for use in open circuits as open-circuit hydraulic pumps connected to the open circuits E to H.

In the present embodiment, the closed-circuit pump 12 is connected to a passage 200 at one input/output port thereof and is connected to a passage 201 at the other input/output port thereof. The passages 200, 201 are connected to plural, e.g., four changeover valves 43*a* to 43*d*. The changeover valves 43*a* to 43*c* are a closed-circuit switching section for switching the supply of hydraulic fluid to the boom cylinder 1, the arm cylinder 3 and the bucket cylinder 5 connected to the closed-circuit pump 12 in a closed-circuit fashion to telescopically drive the hydraulic actuator that is required of these boom cylinder 1, arm cylinder 3 and bucket cylinder 5. The changeover valve 43*d* is a closed-circuit switching section for a swing motor 7*a* which section supplies hydraulic fluid to the swing motor 7*a* connected to the closed-circuit pump 12 in a closed circuit fashion and constituting the swing device 7. The changeover valves 43*a* to 43*d* are each configured to switch the conduction and the cutoff of the passages 200, 201 in response to a control signal outputted from the control device 57 and are each held in a cutoff state when no control signal is given from the control device 57. The control device 57 controls the changeover valves 43*a* to 43*d* not to be brought into conduction states simultaneously.

The changeover valve 43*a* is connected to the boom cylinder 1 through passages 212 and 213. When the changeover valve 43*a* is brought into the conduction state in response to a control signal outputted from the control device 57, the closed-circuit pump 12 constitutes the closed circuit A in which the pump 12 is connected in a closed-circuit fashion to the boom cylinder 1 through the passages 200, 201, the changeover valve 43*a* and the passages 212, 213. The changeover valve 43*b* is connected to the arm cylinder 3 through passages 214 and 215. When the changeover valve 43*b* is brought into the conduction state in response to a control signal outputted from the control device 57, the closed-circuit pump 12 constitutes the closed circuit B in which the pump 12 is connected in a closed-circuit fashion to the arm cylinder 3 through the passages 200, 201, the changeover valve 43*b* and the passages 214, 215.

The changeover valve 43*c* is connected to the bucket cylinder 5 through passages 216 and 217. When the changeover valve 43*c* is brought into the conduction state in response to a control signal outputted from the control device 57, the closed-circuit pump 12 constitutes the closed circuit C in which the pump 12 is connected in a closed-circuit fashion to the bucket cylinder 5 through the passages 200, 201, the changeover valve 43*c* and the passages 216, 217. The changeover valve 43*d* is connected to the swing motor 7*a* through passages 218 and 219. When the changeover valve 43*d* is brought into the conduction state in response to a control signal outputted from the control device 57, the closed-circuit pump 12 constitutes the closed circuit D in which the pump 12 is connected in a closed-circuit fashion to the swing motor device 7*a* through the passages 200, 201, the changeover valve 43*d* and the passages 218, 219.

The passage 212 is connected to open circuits E to H through a plurality of changeover valves 44*a*, 46*a*, 48*a* and 50*a*, and the arm cylinder 3 is supplied with the hydraulic fluid from these open circuits E to H. Similarly, the passage 214 is connected to the open circuits E to H through a plurality of changeover valves 44*b*, 46*b*, 48*b* and 50*b* of the open circuits E to H, referred to later, and the arm cylinder 3 is supplied with the hydraulic fluid from these open circuits E to H. Further, the passage 216 is connected to the open circuits E to H through a plurality of changeover valves 44*c*, 46*c*, 48*c* and 50*c*, and the bucket cylinder 5 is supplied with the hydraulic fluid from the open circuits E to H.

Further, the closed-circuit pump 14 is connected to the passage 203 at one of the input/output ports and is connected to the passage 204 at the other input/output port. The passages 203, 204 are connected to plural, e.g., four changeover valves 45*a* to 45*d*. The closed-circuit pump 16 is connected to a passage 206 at one of the input/output ports and is connected to a passage 207 at the other input/output port. The passages 206, 207 are connected to plural, e.g., four changeover valves 47*a* to 47*d*. The closed-circuit pump 18 is connected to a passage 209 at one of the input/output ports and is connected to a passage 210 at the other input/output port. The passages 209, 210 are connected to plural, e.g., four changeover valves 49*a* to 49*d*. The changeover valves 45*a* to 45*d*, 47*a* to 47*d*, 49*a* to 49*d* are configured in the same manner as the changeover valves 43*a* to 43*d*. Incidentally, the closed-circuit pump 14, 16, 18 and a hydraulic circuit connected to each actuator corresponding thereto take the same configuration as the closed-circuit pump 12, and description regarding these will be omitted.

An outlet port of the open-circuit pump 13 is connected to four changeover valves 44*a* to 44*d* and a relief valve 21 through the passage 202. An inlet port of the open-circuit pump 13 is connected to the reservoir 25 to form the open circuit E. The changeover valves 44*a* to 44*d* are configured as an open circuit switching section that in response to a control signal outputted from the control device 57, switches the passage 202 between conduction and cutoff to switch a supply destination of the hydraulic fluid flowing out from the open-circuit pump 13 to any of coupling passages 301 to 304 as a connecting circuit referred to later, and are each held in the cutoff state when no control signal is given from the control device 57. The control device 57 controls the changeover valves 44*a* to 44*d* not to be brought into conduction states simultaneously.

The changeover valve 44*a* is connected to the boom cylinder 1 through the coupling passage 301 and the passage 212. The coupling passage 301 is a coupling conduit provided to branch from the passage 212. The changeover valve 44*b* is connected to the arm cylinder 3 through the coupling passage 302 and the passage 214. The coupling passage 302 is a coupling conduit provided to branch from the passage 214. The changeover valve 44*c* is connected to the bucket cylinder 5 through the coupling passage 303 and the passage 216. The coupling passage 303 is a coupling conduit provided to branch from the passage 216. The changeover valve 44*d* is connected through the coupling passage 304 and the passage 220 to proportional changeover valves 54 and 55 being control valves that control the supply and discharge of hydraulic fluid to and from the travel devices 8*a*, 8*b*. The relief valve 21 lets the hydraulic fluid in the passage 202 go into the reservoir 25 to protect the hydraulic drive system 105 (hydraulic circuit) when the hydraulic fluid pressure in the passage 202 becomes a predetermined pressure or higher.

Between the passage 202 and the reservoir 25, there is connected a bleed-off valve 64 as a second switching device. The bleed-off valve 64 is connected on a conduit branching from the passage 202 that connects the changeover valves 44*a* to 44*d* to the open-circuit pump 13, and leading to the reservoir 25. The bleed-off valve 64 controls the flow rate of hydraulic fluid flowing from the passage 202 to the reservoir 25 in response to a control signal outputted from the control device 57. The bleed-off valve 64 is held in the cutoff state when no control signal is given from the control device 57.

An outlet port of the open-circuit pump 15 is connected to plural, e.g., four changeover valves 46*a* to 46*d* and a relief valve 22 through the passage 205. An inlet port of the open-circuit pump 15 is connected to the reservoir 25 to form the open circuit F. A flow output port of the open-circuit pump 17 is connected to plural, e.g., four changeover valves 48*a* to 48*d* and a relief valve 23 through a passage 208. An inlet port of the open-circuit pump 17 is connected to the reservoir 25 to form the open circuit G. Further, an outlet port of the open-circuit pump 19 is connected to plural, e.g., four changeover valves 50*a* to 50*d* and a relief valve 24 through a passage 211. An inlet port of the open-circuit pump 19 is connected to the reservoir 25 to form the open circuit H. The changeover valves 46*a* to 46*d*, 48*a* to 48*d*, 50*a* to 50*d* are configured in the same manner as the changeover valves 44*a* to 44*d*, and the relief valves 22 to 24 is configured in the same manner as the relief valve 21. Incidentally, the same is true with the connection relation between the open-circuit pumps 15, 17, 19 and the closed circuits A to D and their operations, regarding which description will therefore be omitted.

The changeover valves 44*a* to 44*d*, 46*a* to 46*d*, 48*a* to 48*d*, 50*a* to 50*d* are of the configuration that operates as a first switching device for controlling the supply of hydraulic fluid from the open-circuits E to H to the closed-circuits A to D and the branch flows of hydraulic fluid from the closed circuit A to D to the open-circuits E to H.

The coupling passage 301 is composed of open-circuit connection passages 305*a* to 308*a* that are connected to discharge sides, being the sides from which hydraulic fluids flow out, of at least respective one changeover valves 44*a*, 46*a*, 48*a*, 50*a* included in the plural open circuits E to H, and a closed-circuit connection passage 309*a* connected to the passage 212 constituting the closed circuit A. The coupling passages 302 to 304 are each configured similarly to the coupling passage 301.

The hydraulic drive system 105 is composed of the closed circuits A to D in which the closed-circuit pumps 12, 14, 16, 18 and the boom cylinder 1, the arm cylinder 3, the bucket cylinder 5 and the swing motor 7*a* are connected so that one outlet/inlet port of each closed-circuit pump 12, 14, 16, 18 is connected through the hydraulic actuator to the other outlet/inlet port in a closed circuit fashion, and is further composed of the open circuits E to H in which the open-circuit pumps 13, 15, 17, 19 and the changeover valves 44*a* to 44*d*, 46*a* to 46*d*, 48*a* to 48*d*, 50*a* to 50*d* are connected so that these open-circuit pumps 13, 15, 17, 19 are connected to the changeover valves 44*a* to 44*d*, 46*a* to 46*d*, 48*a* to 48*d*, 50*a* to 50*d* at respective output ports and to the reservoir 25 at respective input ports. These closed circuits A to D and open circuits E to H are provided four by four, for example, to be paired respectively.

A discharge side of the charge pump 11 is connected through the passage 229 to a charge relief valve 20 and charge check valves 26 to 29, 40*a*, 40*b*, 41*a*, 41*b*, 42*a*, 42*b*. A suction port of the charge pump 11 is connected to the reservoir 25. The charge relief valve 20 regulates a charge pressure acting on the charge check valves 26 to 29, 40*a*, 40*b*, 41*a*, 41*b*, 42*a*, 42*b*.

The charge check valves 26 supply the passages 200, 201 with hydraulic fluid from the charge pump 11 when the hydraulic fluid pressure in the passages 200, 201 falls below a pressure set by the charge relief valve 20. The charge check valves 27 to 29 are configured in the same manner as the charge check valve 26.

The charge check valves 40*a*, 40*b* supply the passages 212, 213 with hydraulic fluid from the charge pump 11 when the hydraulic fluid pressure in the passages 212, 213 falls below a pressure set by the charge relief valve 20. The charge check valves 41*a*, 41*b*, 42*a*, 42*b* are configured in the same manner as the charge check valves 40*a*, 40*b*.

Between the passages 200 and 201, there are connected a pair of relief valves 30*a* and 30*b*. The relief valves 30*a*, 30*b* let the hydraulic fluids in the passages 200, 201 go from a charge conduit 232 being a passage into the reservoir 25 through the charge relief valve 20 to protect the passages 200, 201 when the hydraulic fluid pressure in the passages 200, 201 becomes a predetermined pressure or higher. Likewise, a pair of relieve valves 31*a* and 31*b* are connected between the passages 203 and 204, a pair of relieve valves 32*a* and 32*b* are connected between the passages 206 and 207, and a pair of relieve valves 33*a* and 33*b* are connected between the passages 209 and 210. These relief valves 31*a* to 33*a* and 31*b* to 33*b* are configured in the same manner as the relief valves 30*a* and 30*b*.

The passage 212 is connected to the cap-end chamber 1*a* of the boom cylinder 1. The passage 213 is connected to the rod-end chamber 1*b* of the boom cylinder 1. Relief valves 37*a* and 37*b* are connected between the passages 212 and 213. The relief valves 37*a*, 37*b* let the hydraulic fluids in the passages 212, 213 go from the passage 229 into the reservoir 25 through the charge relief valve 20 to protect the passages 212, 213 when the hydraulic fluids in the passages 212, 213 become a predetermined pressure or higher. A flushing valve 34 is connected between the passages 212 and 213. The flushing valve 34 drains those surplus of the hydraulic fluids (surplus hydraulic fluids) in the passages 212, 213 from the passage 229 into the reservoir 25 through the charge relief valve 20.

The passage 214 is connected to the cap-end chamber 3*a* of the arm cylinder 3. The passage 215 is connected to the rod-end chamber 3*b* of the arm cylinder 3. Relief valves 38*a*, 38*b* and a flushing valve 35 are connected between the passages 214 and 215. The passage 216 is connected to the cap-end chamber 5*a* of the bucket cylinder 5. The passage 217 is connected to the rod-end chamber 5*b* of the bucket cylinder 5. Relief valves 39*a*, 39*b* and a flushing valve 36 are connected between the passages 216 and 217. The relief valves 38*a*, 38*b*, 39*a*, 39*b* are configured in the same manner as the relief valves 37*a* and 37*b*, and the flushing valves 35, 36 are configured in the same manner as the flushing valve 34.

The passages 218 and 219 are connected to the swing device 7. Relief valves 51*a* and 51*b* are connected between the passages 218 and 219. The relief valves 51*a*, 51*b* let the hydraulic fluid in the passage 218, 219 on a higher pressure side go to the passage 219, 218 on a lower pressure side to protect the passages 218, 219 when the difference in hydraulic fluid pressure between the passages 218 and 219 (passage-to-passage pressure difference) becomes a predetermined pressure or higher.

The proportional control valve 54 and the travel device 8*a* are connected through passages 221 and 222. Relief valves 52*a* and 52*b* are connected between the passages 221 and 222. The relief valves 52*a*, 52*b* let the hydraulic fluid in the passage 221, 222 on a higher pressure side go to the passage 222, 221 on a lower pressure side to protect the passages 221 and 222 when the difference in hydraulic fluid pressure between the passages 221 and 222 becomes a predetermined pressure or higher. The proportional changeover valve 54 is of the configuration being adjustable inlet rate that alternately switches the connection destinations of the passage 220 and the reservoir 25 to either of the passages 221 and 222 in response to a control signal outputted from the control device 57.

The proportional changeover valve 55 and the travel device 8*b* are connected through passages 223 and 224. Relief valves 53*a* and 53*b* are connected between the passages 223 and 224. The proportional changeover valve 55 is configured similarly to the the proportional changeover valve 54, and the relief valves 53*a* and 53*b* are configured similarly to the relief valves 52*a*, 52*b*.

The control device 57 controls the respective regulators 12*a* to 19*a*, the changeover valves 43*a* to 50*a*, 43*b* to 50*b*, 43*c* to 50*c*, 43*d* to 50*d* and the proportional changeover valves 54, 55 based on command values that are from the control lever device 56 and that are indicative of extension/retraction directions and extension/retraction speeds of the boom cylinder 1, the arm cylinder 3 and the bucket cylinder 5, turn directions and turn speeds of the swing device 7 and the travel devices 8*a*, 8*b*, and various sensor information given in the hydraulic drive system 105.

Specifically, the control device 57 performs a pressurized area ratio control that controls a first flow rate that is, for example, the flow rate of the closed-circuit pump 12 on the passage 212 side connected to the cap-end chamber 1*a* and the rod-end chamber 1*b* of the boom cylinder 1, and a second flow rate that is the flow rate of the open-circuit pump 13 connected to the coupling passage 301 through the changeover valve 44*a*, so that the ratio of the first flow rate to the second flow rate becomes a predetermined value which is set beforehand in correspondence to the pressurized areas of the cap-end chamber 1*a* and the rod-end chamber 1*b* of the boom cylinder 1. Likewise, the control device 57 performs the aforementioned pressurized area ratio control with respect to each of the arm cylinder 3 and the bucket cylinder 5 besides the boom cylinder 1.

When driving at least one of the boom cylinder 1, the arm cylinder 3 and the bucket cylinder 5, the control device 57 suitably controls the changeover valves 43*a* to 50*a*, 43*b* to 50*b*, 43*c* to 50*c*, 43*d* to 50*d* to supply the at least one being driven of the boom cylinder 1, the arm cylinder 3 and the bucket cylinder 5 with the hydraulic fluid discharged from the closed-circuit pumps 12, 14, 16, 18 being the same in number as the corresponding open-circuit pumps 13, 15, 17, 19.

The control lever 56*a* of the control lever device 56 gives the control device 57 command values indicative of the extension/retraction direction and the extension/retraction speed for the boom cylinder 1. The control lever 56*b* gives the control device 57 command values indicative of the extension/retraction direction and the extension/retraction speed for the arm cylinder 3, and the control lever 56*c* gives the control device 57 command values indicative of the extension/retraction direction and the extension/retraction speed for the bucket cylinder 5. The control lever 56*d* gives the control device 57 command values indicative of the turn direction and the turn speed of the swing device 7. Incidentally, control levers (not shown) are also provided that give the control device 57 command values indicative of the turn direction and the turn speed for the travel devices 8*a*, 8*b*.

<Configuration of Major Part>

Figure 3:
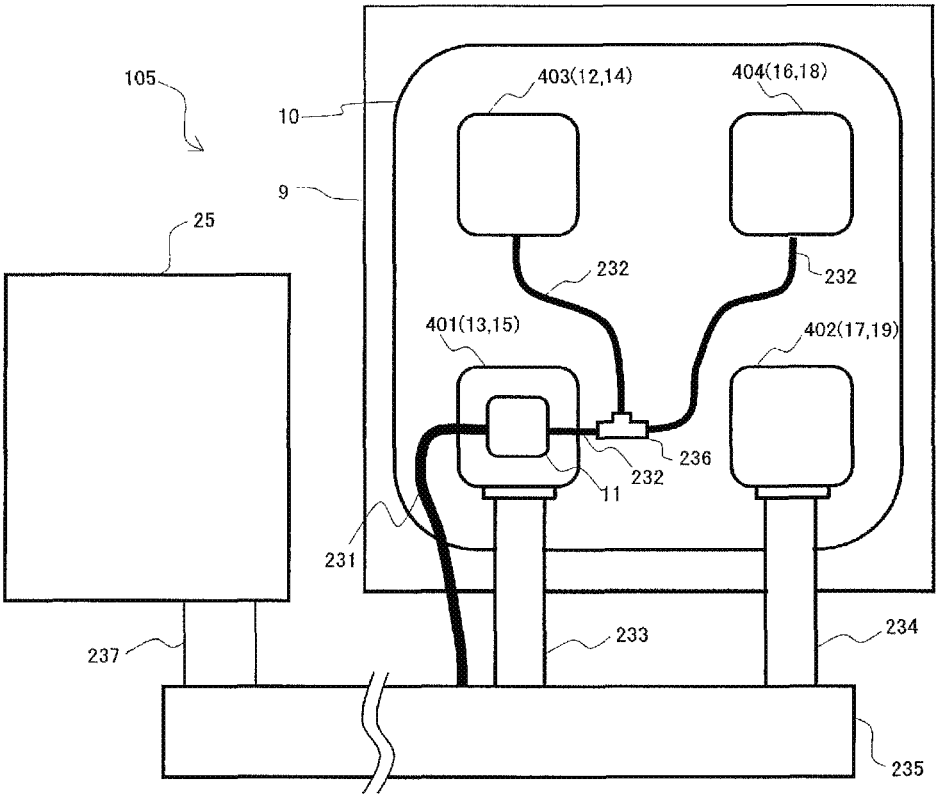
FIG. 3 is a schematic side view showing the configuration of a major part of the hydraulic drive system.
Figure 4:
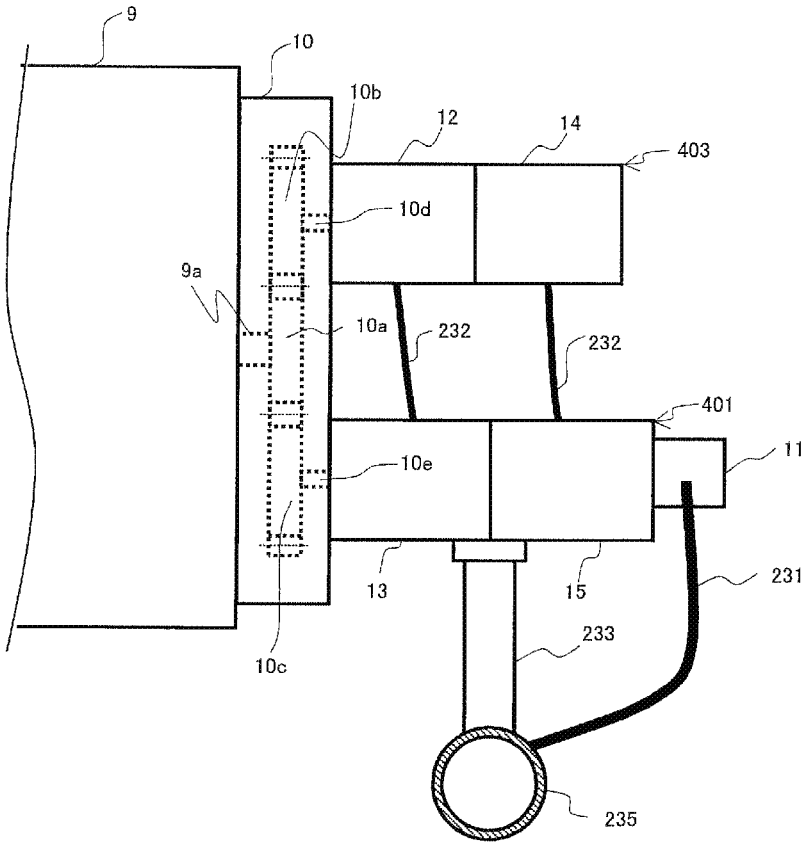
FIG. 4 is a schematic front view showing the configuration of the major part of the hydraulic drive system.
Figure 5:
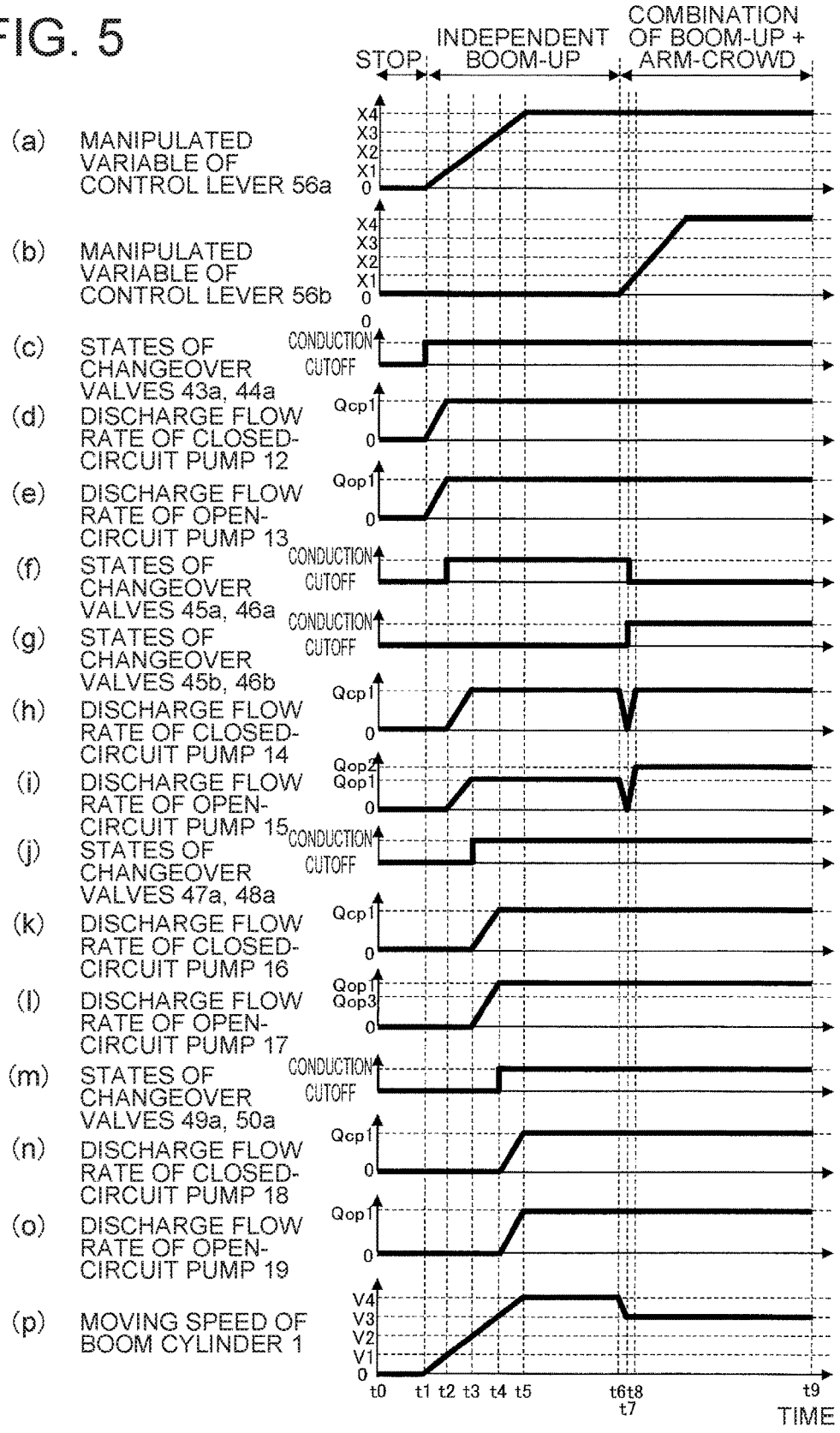
FIG. 5 is a time chart showing the states that the hydraulic drive system is in an independent operation for boom-up and in a combined operation involving boom-up and arm-crowd, wherein (a) denotes the manipulated variable of a control lever 56*a*, (b) denotes the manipulated variable of a control lever 56*b*, (c) denotes the states of changeover valves 43*a* and 44*a*, (d) denotes the discharge flow rate of a closed-circuit pump 12, (e) denotes the discharge flow rate of an open-circuit pump 13, (f) denotes the states of changeover valves 45*a* and 46*a*, (g) denotes the states of changeover valve 45*b* and 46*b*, (h) denotes the discharge flow rate of a closed-circuit pump 14, (i) denotes the discharge flow rate of an open-circuit pump 15, (j) denotes the states of changeover valves 47*a* and 48*a*, (k) denotes the discharge flow rate of a closed-circuit pump 16, (l) denotes the discharge flow rate of an open-circuit pump 17, (m) denotes the states of changeover valves 49*a* and 50*a*, (n) denotes the discharge flow rate of a closed-circuit pump 18, (o) denotes the discharge flow rate of an open-circuit pump 19, and (p) denotes the moving speed of a boom cylinder 1.

FIG. 3 is a schematic side view showing the configuration of a major part of the hydraulic drive system 105 which directly relates to the present invention. FIG. 4 is a schematic front view showing the major part of the hydraulic drive system 105. These FIG. 3 and FIG. 4 show piping arrangements around the closed-circuit pumps and open-circuit pumps 12 to 19, wherein the piping arrangement on the discharge side is omitted while the piping arrangement on the suction side only is shown.

The rotational power of the engine 9 is divided by the power transmission device 10 into four rotational shafts to drive the respective closed-circuit pumps and open-circuit pumps 12 to 19. As shown in FIG. 1, FIG. 3 and FIG. 4, the power transmission device 10 is installed on a lateral surface of the engine 9. In the interior of the power transmission device 10, there are housed a drive gear 10*a* fixed on a drive shaft 9*a* of the engine 9 and driven gears 10*b*, 10*c* of four in total. The open-circuit pumps and closed-circuit pumps 12 to 19 each take a dual tandem configuration, wherein the open-circuit pumps 13, 15, the open-circuit pumps 17, 19, the closed-circuit pumps 12, 14 and the closed-circuit pumps 16, 18 are respectively configured as independent tandem pumps 401 to 404 respectively driven on the same axis. Particularly, the tandem pump 401 composed of the open-circuit pumps 13, 15 has the charge pump 11 installed coaxially and thus, is configured as a triple tandem configuration in which the charge pump 11 is also driven coaxially. Incidentally, although taking tandem configurations, the respective closed-circuit pumps and open-circuit pumps 12 to 19 may, without being limited to this, be installed as, for example, individual pumps being large in capacity.

The tandem pump 403 composed of the closed-circuit pumps 12, 14 and the tandem pump 404 composed of the closed-circuit pumps 16, 18 are installed to be connected with two shafts on the upper side (10*d* side) of the power transmission device 10 above the drive shaft 9*a* of the engine 9. The tandem pump 401 composed of the open-circuit pumps 13, 15 and the charge pump 11 and the tandem pump 402 composed of the open-circuit pumps 17, 19 are installed to be connected with two shafts on the lower side (10*e* side) of the power transmission device 10 below the drive shaft 9*b* of the engine 9. The tandem pump 403 is installed over the tandem pump 401, and the tandem pump 404 is installed over the tandem pump 402. That is, these tandem pumps 401 to 404 are arranged to be spaced at respective corner portions of a regular square, as shown in FIG. 3.

As shown in FIG. 1, the reservoir 25 is installed on a frame 102*a* supporting the upperstructure 102 with a lower surface of the reservoir 25 located below a lower surface of the engine 9.

A main pipe 235 as a first connection pipe is installed blow the reservoir 25. The main pipe 235 is horizontally installed to extend from under the reservoir 25 through under the tandem pump 401 composed of the open-circuit pumps 13, 15 and the tandem pump 402 composed of the open-circuit pumps 17, 19, as shown in FIG. 4, and the main pipe 235 takes a shape that is closed at opposite ends. The lower surface of the reservoir 25 and an upper side portion on one-end side of the main pipe 235 are coupled by a coupling pipe 237 as the first connection pipe. The coupling pipe 237 is for leading the hydraulic fluid stored in the reservoir 25 to the main pipe 235 and is attached with its axial direction oriented vertically.

As shown in FIG. 3 and FIG. 4, the tandem pumps 401, 402 and the main pipe 235 are connected by respective suction pipes 233, 234 as second connection pipes. The suction pipes 233, 234 are for leading the hydraulic fluid led to the main pipe 235 to respective inlet ports of the respective open-circuit pumps 13, 15, 17, 19 of the tandem pumps 401, 402 and are attached with respective axial directions oriented vertically. The respective suction pipes 233, 234 are connected to the upper side portion of the main pipe 235 on the lower end sides thereof and to lower side portions of the respective tandem pumps 401, 402 on the upper end sides thereof.

The main pipe 235 is connected with one end of a suction conduit 231 whose the other end is connected to the suction port of the charge pump 11. The one end of the suction conduit 231 is connected with the upper side portion of the main pipe 235 to lead the hydraulic fluid led to the main pipe 235 to the inlet port of the charge pump 11. A discharge port of the charge pump 11 is connected with one end of the charge conduit 232. The other end of the charge conduit 232 branches at a branching block 236 to be connected with the respective closed-circuit pumps 12, 14, 16, 18 of the tandem pumps 403, 404.

From the standpoint of reducing resistance at the time of suction to prevent cavitation from being generated in the respective open-circuit pumps 13, 15, 17, 19, the respective suction pipes 233, 234 are designed to be larger in inside diameter than the suction conduit 231. On the other hand, because the hydraulic drive system 105 is capable of compensating for the hydraulic fluid flow rate equivalent to the difference in pressurized area of, for example, the boom cylinder 1 or the like by the supply of hydraulic fluid from the open-circuit pumps 13, 15, 17, 19, the charge pump 11 suffices to be a charge pump of a small capacity, so that the suction conduit 231 is made to be greatly smaller in inside diameter than the suction pipes 233, 234. Like the suction conduit 231, the charge conduits 232 are also made to be small in inside diameter.

<Operation and Effect>

In the drive system described in Patent Literature 1 as aforementioned, one open-circuit is provided together with plural closed-circuits, and the flow rate of hydraulic fluid supplied from the one open-circuit to the plural closed-circuits is distributed by a distribution circuit, so that in comparison with the case that the operation is performed by a closed-circuit hydraulic pump alone, the operation speed of a single-rod cylinder is increased by supplying hydraulic fluid from the one open-circuit to the closed circuit through the distribution circuit.

Particularly, where a single-rod cylinder is driven by a closed circuit, because the pressurized area on a cap-end chamber side differs from the pressurized area on a rod-end chamber side, it is necessary to supply (charge) the closed circuit with hydraulic fluid of the flow rate equivalent to the difference in the pressurized area, when the single-rod cylinder is operated to extend. However, in the drive system described in Patent Literature 1 as aforementioned, the imbalance caused by the aforementioned pressurized area difference when the single-rod cylinder is operated to extend is suppressed by supplying hydraulic fluid from the hydraulic pump in the open circuit to the cap-end chamber side of the cylinder, so that the supply flow rate (charge flow rate) of hydraulic fluid by a charge pump is made to be little.

Further, where a plurality of hydraulic actuators are driven by closed circuits, it is required to provide hydraulic pumps for respective hydraulic actuators, and thus, although a problem remains in that the number of hydraulic pumps tends to increase in a work machine such as a hydraulic excavator, the drive system can be configured in the combination with an open-circuit, wherein the hydraulic fluid discharged from a hydraulic pump in the open circuit can be supplied to each of plural hydraulic actuators through control valves, so that the number of the pumps can be decreased. For example, a configuration may be conceived of wherein closed circuits are used as circuits for driving a boom, an arm and the like which each require a relatively large energy at the time of an operation while open circuits are used as circuits for driving travel motors which are low in frequency of use and sufficient to be a relatively small energy at the time of an operation.

In the hydraulic drive system 105 according to the foregoing first embodiment, the closed circuits A to D are used as the circuits for driving the boom cylinder 1, the arm cylinder 3, the bucket cylinder 5 and the swing device 7, while the open circuits E to H are used as the circuits for driving the respective travel devices 8*a*, 8*b*. Then, the open circuits E to H are provided together with the respective closed circuits A to D, in which configuration is taken so that in addition to the supply of hydraulic fluid from the closed-circuit pumps 12, 14, 16, 18 provided in these closed circuits A to D, the hydraulic fluid discharged by the open-circuit pumps 13, 15, 17, 19 provided in the closed circuits E to H is supplied to the cap-end chambers 1*a*, 3*a*, 5*a* side of the boom cylinder 1, the arm cylinder 3 and the bucket cylinder 5 each having a difference in pressurized area.

As a result, because compensation can be made for the flow rates that are equivalent to the differences in pressurized areas between the cap-end chambers 1*a*, 3*a*, 5*a* and the rod-end chambers 1*b*, 3*b*, 5*b* of the boom cylinder 1, the arm cylinder 3 and the bucket cylinder 5, the respective closed-circuit pumps 12, 14, 16, 18 can be downsized, and at the same time, the charge pump 11 is not required to be increased in dimension. Further, combined operations of six patterns by the boom cylinder 1, the arm cylinder 3, the bucket cylinder 5, the swing device 7 and the respective travel devices 8*a*, 8*b* can easily be done by the use of the open-circuit pumps 13, 15, 17, 19 and the proportional changeover valves 54 and 55.

Where the boom cylinder 1 is operated to extend for example, the discharge flow rate (Qcp1) of the closed-circuit pump 12 and the discharge flow rate (Qop1) of the open-circuit pump 13 are determined so that the area ratio (Aa1:Aa2) of the pressurized area (Aa1) at the bottom chamber 1*a* to the pressurized area (Aa2) at the rod-end chamber 1*b* of the boom cylinder 1 becomes equal to the flow rate ratio {(Qcp1+Qop1):Qcp1} between the closed-circuit pump 12 and the open-circuit pump 13. Because the area ratio (Aa1:Aa2) of these bottom chamber 1*a* and rod-end chamber 1*b* is approximately 2:1 or so, the flow rate of the closed-circuit pump 12 and the flow rate of the open-circuit pump 13 becomes almost the same flow rate, so that these closed-circuit pump 12 and open-circuit pump 13 becomes almost the same in pump flow rate and specification.

Each open-circuit pumps 13, 15, 17, 19 is a pump that draws the hydraulic fluid in the reservoir 25 and discharges the hydraulic fluid, and thus, in order to realize a proper pump operation, it is necessary to reduce resistance in drawing the hydraulic fluid from the reservoir 25. On the other hand, each closed-circuit pump 12, 14, 16, 18 is for operating a hydraulic actuator as a result of switching the discharge direction from the pump in the closed-circuits A to D annularly connected to the hydraulic actuator such as, for example, the boom cylinder 1 and of adjusting the discharge flow rate and thus, does not need drawing hydraulic fluid from the reservoir 25 as is done by the open-circuit pump 13, 15, 17, 19. Each open-circuit pump 13, 15, 17, 19 draws hydraulic fluid from the reservoir 25 through the suction pipe 233, 234, and the suction performance is influenced by the pressure loss of the suction pipe 233, 234 in addition to the self-priming efficiency possessed by the open-circuit pump 13, 15, 17, 19. From the standpoint of the self-priming efficiency, with the suction capacity of the open-circuit pump 13, 15, 17, 19 taken into consideration, the suction pipe 233, 234 is connected to the bottom surface of the reservoir 25 through the main pipe 235 and the coupling pipe 237. Further, the pressure loss of each suction pipe 233, 234 depends on the pipe section and the length. Therefore, in order to improve the suction performance, the suction pipes 233, 234 should be in the connection as aforementioned, be as short as possible and be limited to, if possible, a minimum necessary length. The suction pipes 233, 234 are located below the reservoir 25 and the closed-circuit pumps 12, 14, 16, 18, and as a result, these closed-circuit pumps 12, 14, 16, 18 are located above the open-circuit pumps 13, 15, 17, 19. Therefore, the suction pipes 233, 234 can be made as short as possible, and the pressure loss of the suction pipes 233, 234 can be restrained.

For this reason, in the hydraulic drive system 105 according to the foregoing first embodiment, as shown in FIG. 3 and FIG. 4, the tandem pump 403 composed of the closed-circuit pumps 12, 14 and the tandem pump 404 composed of the closed-circuit pumps 16, 18 are installed respectively above the tandem pump 401 composed of the open-circuit pumps 13, 15 and the charge pump 11 and the tandem pump 402 composed of the open-circuit pumps 17, 19.

That is, the closed-circuit pumps 12, 14, 16, 18 are installed respectively above the open-circuit pumps 13, 15, 17, 19. Thus, in comparison with the case that the respective open-circuit pumps are installed above the closed-circuit pumps, because each of the suction pipes 233, 234 can be shortened, and because the suction height relative to the surface of the hydraulic fluid in the reservoir 25 can be lowered, it becomes possible to reduce the resistance arising when each open-circuit pump 13, 15, 17, 19 draws hydraulic fluid, and hence, to improve the suction capability and the self-priming efficiency of each open-circuit pump 13, 15, 17, 19. Accordingly, even in the case that hydraulic fluid of a large flow rate is discharged by each open-circuit pump 13, 15, 17, 19, cavitation can be prevented from being built up, and erosion and noise can be restrained from being generated. Because the resistance in drawing hydraulic fluid is small, stable pump operations can be realized, so that stable body operations can be realized in the hydraulic excavator 100.

Further, by placing the respective open-circuit pump 13, 15, 17, 19 below the closed-circuit pumps 12, 14, 16, 18, it becomes unnecessary at the same time to arrange the suction pipes 233, 234 of a relatively large diameter to go through by the closed-circuit pumps 12, 14, 16, 18. Accordingly, the piping arrangement around the respective open-circuit pumps 13, 15, 17, 19, inclusive of the piping for discharge side, can be made easily, the mountability can be improved, and further, the maintainability of these open-circuit pumps 13, 15, 17, 19 can be improved. From the above, in the hydraulic drive system 105 combining the closed-circuits A to D with the open circuits E to H, the mounting layout of the closed-circuit pumps 12, 14, 16, 18 and the open-circuit pumps 13, 15, 17, 19 can be made to be appropriate, stable pump operations and vehicle body operations can be realized even in high-speed operations of the single-rod cylinders such as the boom cylinder 1, and at the same time, the maintainability around the closed-circuit pumps 12, 14, 16, 18 and the open-circuit pumps 13, 15, 17, 19 can be improved, so that the hydraulic excavator 100 can be enhanced in reliability.

Further, the inside diameters of the main pip 235, the coupling pipe 237 and the suction pipes 233, 234 are set so that the hydraulic fluid passing therethrough becomes a predetermined flow rate or less and a pressure or higher that is beforehand set at each inlet port of each open-circuit pump 13, 15, 17, 19. Further, since the setting is made like this, the inside diameters of the main pipe 235 and the coupling pipe 237 are set to be larger than the inside diameter of the suction pipes 233, 234. Furthermore, the connection from the reservoir 25 to the lower side of the open-circuit pumps 13, 15, 17, 19 is constituted by the main pipe 235 and the coupling pipe 237, and the connection between the main pipe 235 and the inlet ports of the respective open-circuit pumps 13, 15, 17, 19 is constituted by the suction pipes 233, 234. As a result, because the suction pipes 233, 234 are made to be an inside diameter being as large as possible and to be as short as possible, the pressure loss of the suction pipes 233, 234 can be restrained, and at the same time, because the main pipe 235 is enabled to go through the space under the reservoir 25 and the respective open-circuit pumps 13, 15, 17, 19, the layout becomes ease.

Second Embodiment

Figure 6:
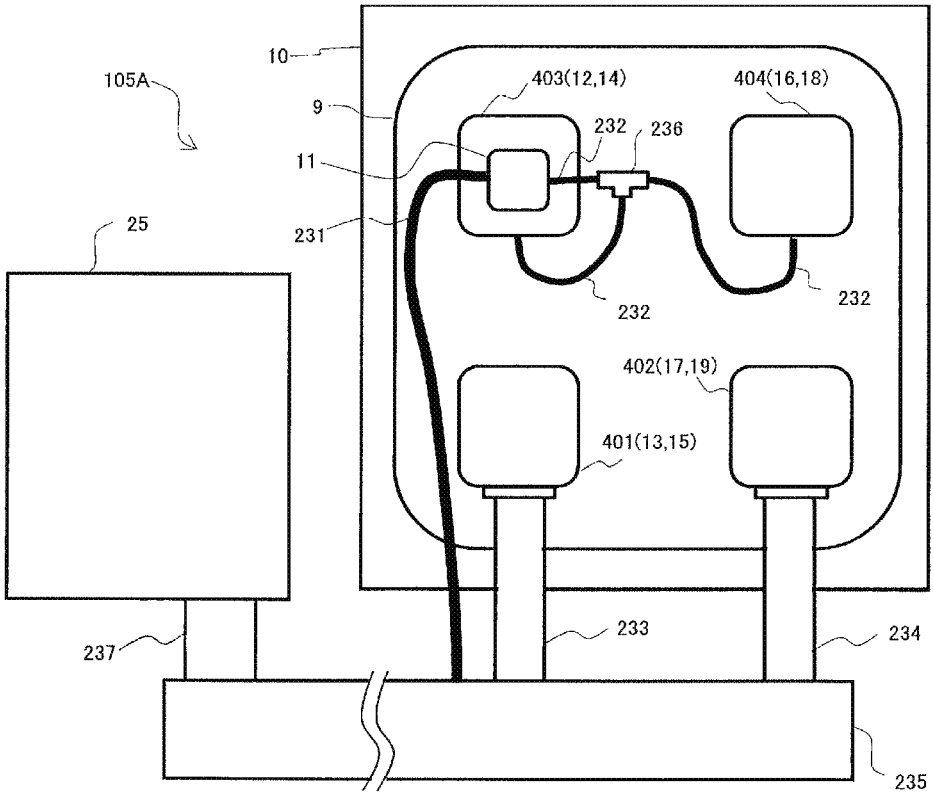
FIG. 6 is a schematic side view showing a part of a hydraulic drive system mounted on a work machine according to a second embodiment of the present invention.

FIG. 6 is a schematic side view showing a part of a hydraulic drive system 105A mounted on a work machine according to a second embodiment of the present invention. The difference of the present second embodiment from the first embodiment resides in that the first embodiment is directed to the hydraulic drive system 105 having the charge pump 11 mounted coaxially of the open-circuit pumps 13, 15, while the second embodiment is directed to the hydraulic drive system 105A having the charge pump 11 mounted coaxially of the closed-circuit pumps 12, 14. Incidentally, in the present second embodiment, parts being identical or corresponding to those in the first embodiment are given the same reference numerals.

In the present second embodiment, the charge pump 11 is mounted coaxially of the tandem pump 403 composed of the closed-circuit pumps 12, 14. The tandem pump 403 takes a triple tandem configuration which is able to coaxially drive the charge pump 11 in addition to the closed-circuit pumps 12, 14.

That is, because being for replenishing hydraulic fluid of the flow rate due to the pressurized area difference that occurs when the single-rod cylinder such as, for example, the boom cylinder 1 operates to extend, the charge pump 11 suffices to be relatively smaller in pump flow rate than the open-circuit pumps and close-circuit pumps 12 to 19 that are for operating the hydraulic actuators like these single-rod cylinders. For this reason, in comparison with the hydraulic drive system 105 according to the foregoing first embodiment, the suction conduit 231 should be made to be long, whereas the respective charge conduits 232 connected to the inlet ports of the respective closed-circuit pumps 12, 14, 16, 18 can be shortened.

Third Embodiment

Figure 7:
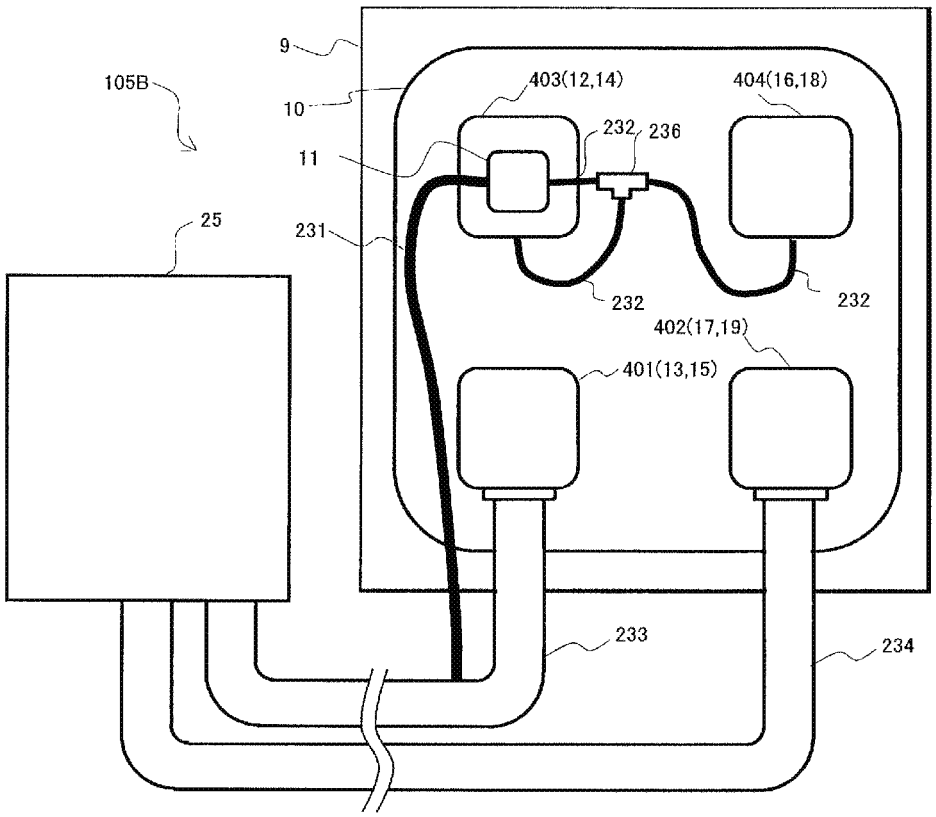
FIG. 7 is a schematic side view showing a part of a hydraulic drive system mounted on a work machine according to a third embodiment of the present invention.

FIG. 7 is a schematic side view showing a part of a hydraulic drive system 105B mounted on a work machine according to a third embodiment of the present invention. The difference of the present third embodiment from the second embodiment resides in that the second embodiment is directed to the hydraulic drive system 105A having the respective suction pipes 233, 234 connected to the main pipe 235 and also having the main pipe 235 connected to the reservoir 25, while the third embodiment is directed to the hydraulic drive system 105B having the suction pipes 233, 234 themselves connected directly to the reservoir 25. Incidentally, in the present third embodiment, parts being identical or corresponding to those in the second embodiment are given the same reference numerals.

In the present third embodiment, each suction pipe 233, 234 connected to either of the tandem pumps 401, 402 at one end is connected at the other end to the bottom surface of the reservoir 25, wherein there is taken a configuration in which the hydraulic fluid in the reservoir 25 is drawn by the open-circuit pumps 13, 15, 17, 19 of the respective tandem pumps 401, 402 through the suction pipes 233, 234 only. Each suction pipe 233, 234 is formed to be bent through almost 90 degrees in the same direction at opposite end portions of the lengthwise direction and is installed on the frame 102*a* with a middle portion held in a horizontal state.

Then, because there is used a configuration that the suction pipes 233, 234 having an inside diameter suitable for the respective open-circuit pumps 13, 15, 17, 19 are connected to the reservoir 25, it is possible to restrain the pressure loss at each suction pipe 233, 234. In addition to this, even in the case where, for example, no room remains in a space (piping space) through which pipes are made to go between the reservoir 25 and the respective open-circuit pumps 13, 15, 17, 19 and where the suction pipes 233, 234 of the inside diameter being thick and a large diameter are not easy to go through such a space, piping becomes easier to go through the space between the reservoir 25 and the respective open-circuit pumps 13, 15, 17, 19 by the use of a plurality of suction pipes 233, 234 being thin and small in inside diameter.

[Others]

Incidentally, it is to be noted that the present invention is not limited to the foregoing embodiments and may encompass various modified forms. For example, the foregoing embodiments have been described for the purpose of describing the present invention to be easily understood, and the present invention is not necessarily limited to those provided with all of the described configurations.

Further, although in each of the foregoing embodiments, description has been made regarding the independent operation for boom-up and the combined operation involving boom-up and arm-crowd, the present invention is also applicable to the independent operations and the combined operations involving other single-rod cylinders such as the boom cylinder 1, the arm cylinder 3, and the bucket cylinder 5.

Furthermore, although in each of the foregoing embodiments, description has been made taking as an example the case wherein the present invention is applied to the hydraulic excavator 100, the present invention is also applicable to other work machines than the hydraulic excavator 100. For example, the present invention is applicable as long as it is directed to a work machine such as a hydraulic crane or a wheel loader which machine is provided with at least one single-rod cylinder capable of being driven.

Further, in each of the foregoing embodiments, hydraulic pumps with a single-tilting swash plate mechanism capable of controlling flow rate only are used as the open-circuit pumps 13, 15, 17, 19, there may be used hydraulic pumps with a double-tilting swash plate mechanism capable of controlling discharge direction and flow rate. Further, although the configuration is taken that the closed-circuit pumps and open-circuit pumps 12 to 19 are each connected to one engine 9 through the power transmission device 10, there may be provided a plurality of hydraulic pumps of a fixed displacement type as these closed-circuit pumps and open-circuit pumps 12 to 19, in which case there may be taken a configuration that these hydraulic pumps of the fixed displacement type are connected with electric motors each being controllable in rotational direction and rotational speed and that these electric motors are controlled by the control device 57 to control the discharge/suction direction and the discharge flow rate in dependence on the rotational direction and the rotational speed of each hydraulic pump of the fixed displacement type.

Furthermore, in each of the foregoing embodiments, the changeover valves 44*a* to 44*d*, 46*a* to 46*d*, 48*a* to 48*d*, 50*a* to 50*d*, the direction changeover valves 54, 55, 60, 63 and the bleed-off valves 64 to 67 may not only be directly controlled in response to control signals outputted from the control device 57, but may also be controlled in response to hydraulic signals into which the control signals from the control device 57 are converted by the use of electromagnetic reducing valves or the like.

REFERENCE SIGNS LIST

1 Boom cylinder (single-rod cylinder)
1*a* Cap-end chamber
1*b* Rod-end chamber
1*c* Rod
1*e* Piston
3 Arm cylinder (single-rod cylinder)
3*a* Cap-end chamber
3*b* Rod-end chamber
3*c* Rod
3*e* Piston
5 Bucket cylinder (single-rod cylinder)
5*a* Cap-end chamber
5*b* Rod-end chamber
5*c* Rod
5*e* Piston
12, 14, 16, 18 Closed-circuit pump (closed-circuit hydraulic pump)
13, 15, 17, 19 Open-circuit pump (open-circuit hydraulic pump)
25 reservoir
57 Control device
100 Hydraulic excavator (work machine)
105, 105A, 105B Hydraulic drive system
233, 234 Suction pipe (connection pipe, second connection pipe)
235 Main pipe (first connection pipe)
237 Coupling pipe (first connection pipe)
301 to 304 Coupling passage (connection circuit)
A, B, C, D Closed circuit
E, F, G, H Open circuit

The invention claimed is:

1. A work machine comprising:

an undercarriage provided with a travel device;

an upperstructure pivotally attached to the undercarriage;

a closed circuit provided with at least one closed-circuit hydraulic pump having two outlet/inlet ports each enabling the outlet and inlet of hydraulic fluid in both directions and a single-rod cylinder having a piston, a cap-end chamber into which the hydraulic fluid is introduced when the piston extends, and a rod-end chamber into which the hydraulic fluid is introduced when the piston retracts, the two outlet/inlet ports of the closed-circuit hydraulic pump being annularly connected with the cap-end chamber and the rod-end chamber;

an open circuit provided with an open-circuit hydraulic pump having an inlet port into which hydraulic fluid flows from a reservoir, and an outlet port from which hydraulic fluid flows out;

a connection circuit which introduces the hydraulic fluid flowing out from the open-circuit hydraulic pump into the closed circuit;

an engine; and a power transmission device that includes four rotational shafts and transmits a rotational power of the engine to the closed-circuit hydraulic pump and the open-circuit hydraulic pump; wherein the reservoir is mounted on a frame supporting the upperstructure;

the engine is mounted on the frame adjacent to the reservoir;

the closed-circuit hydraulic pump is connected to the two upper rotational shafts among the four rotational shafts; and the open-circuit hydraulic pump is connected to the two lower rotational shafts among the four rotational shafts.

2. The work machine according to claim 1, comprising:

a plurality of the open-circuit hydraulic pumps;

a first connection pipe connected to the reservoir; and a plurality of second connection pipes connected to the first connection pipe at respective one ends and connected to inlet ports of the plurality of open-circuit hydraulic pumps at the respective other ends.

3. The work machine according to claim 1, comprising:

a plurality of the open-circuit hydraulic pumps; and a plurality of connection pipes connected to the reservoir at respective one ends and connected to the inlet ports of the plurality of open-circuit hydraulic pumps at the respective other ends.

* * * * *